US005951922A

United States Patent [19]

Mazzei

[11] Patent Number: 5,951,922

[45] Date of Patent: Sep. 14, 1999

[54] AERATION SYSTEM FOR SUBSTANTIAL BODIES OF WATER

[76] Inventor: Angelo L. Mazzei, 11101 Mountain View Rd., Bakersfield, Calif. 93307

[21] Appl. No.: 09/021,720

[22] Filed: Feb. 10, 1998

[51] Int. Cl.[6] ..... B01F 3/04

[52] U.S. Cl. ..... 261/36.1; 261/76; 261/121.1; 239/402; 239/403; 239/466; 239/489; 366/163.2

[58] Field of Search ..... 55/468; 96/202; 137/888; 210/198.1, 220; 239/399, 402, 403, 466, 487, 489; 261/36.1, 37, 59, 76, 121.1, DIG. 42, DIG. 75; 366/163.2

[56] References Cited

U.S. PATENT DOCUMENTS

| | | | |
|---|---|---|---|
| 550,336 | 11/1895 | Williams | 239/489 |
| 2,361,150 | 10/1944 | Petroe | 137/888 |
| 2,603,280 | 7/1952 | Bernhard | 239/489 |
| 2,765,028 | 10/1956 | Kienle | 239/489 |
| 3,033,278 | 5/1962 | Scarr, Jr. | 239/487 |
| 3,556,412 | 1/1971 | Vietorisz | 239/489 |
| 3,799,195 | 3/1974 | Hermans | 366/163.2 |
| 4,123,800 | 10/1978 | Mazzei | 366/163.2 |
| 4,344,752 | 8/1982 | Gallagher, Jr. | 137/888 |
| 4,514,343 | 4/1985 | Cramer et al. | 261/37 |
| 5,514,267 | 5/1996 | Machiya et al. | 261/DIG. 42 |
| 5,525,242 | 6/1996 | Kerecz | 210/220 |
| 5,624,609 | 4/1997 | Serres et al. | 261/36.1 |
| 5,674,312 | 10/1997 | Mazzei | 55/468 |
| 5,743,637 | 4/1998 | Ogier | 366/163.2 |

*Primary Examiner*—C. Scott Bushey
*Attorney, Agent, or Firm*—Donald D. Mon

[57] ABSTRACT

A system for aerating substantial bodies of water which includes a cavitating mixer-injector to inject air into a stream passing through the injector, the mixer-injector having twisting and straightening vanes in a respective conveying and an expanding portion, a nozzle with twisting vanes in a constricting portion, and a conduit connecting the outlet of the mixer-injection to the inlet of the nozzle. The conduit preferably provides dwell time for a suitable amount of injected air to dissolve in the stream before entering the nozzle.

2 Claims, 3 Drawing Sheets

AERATION SYSTEM FOR SUBSTANTIAL BODIES OF WATER

FIELD OF THE INVENTION

Apparatus for aerating substantial bodies of water, for example lakes, pools, sumps and collection ponds, as well as industrial/municipal waste treatment facilities.

BACKGROUND OF THE INVENTION

Aeration of substantial bodies of water to provide an oxidizer for such purposes as odor control, elimination of substances with a high biological or biochemical oxygen demand (BOD) is a well-established art. The objective is to inject oxygen into the body of water where it will attend to the problem. Bodies of water which require such treatment suffer from an overload of offensive materials, and from an inadequate source of oxygen to attend to it.

There are many methods of supplying additional oxygen to the body of water. Well-known examples are bubbling air through it, spraying the water in the air to take on oxygen, and returning it to the body of water, and running water from the body of water through a venturi type injector to pick up air and return oxygen-enriched water to the parent body of water.

Having in mind the widespread need for treatment of such water, and the long duration of the need, it is surprising that there still remained to be invented an elegantly simple system which can provide important improvements over existing equipment and processes. But this invention does provide such an improvement.

Supplying oxygen to the body of water does only minimal good unless it is supplied in a manner such that it can be taken up quickly and efficiently, and unless it reaches into regions which require it. Sprayers, bubblers and circulating pumps represent efforts to increase the volumetric extent of the regions being treated. However, these and other common expedients face the vagaries of the geometry of the body of water, and often involve inefficient means to take up oxygen both in a recirculating stream and in the body of water itself.

It is an object of this invention to provide an importantly increased amount of dissolved oxygen in water to be injected into the body of water, accompanied by a myriad of micro-bubbles containing oxygen and other gases from the air, and then to inject this treated water into the body of water through an especially advantageous nozzle.

It is an object of this nozzle to discharge its effluent into the body of water in such a pattern that its effluent plume is importantly enlarged, so as to draw and mix into it a substantial amount of surrounding water, thereby further "amplifying" the effectiveness of the already oxygen-enriched water by actively mixing it in a vigorously turbulent enlarging region in the body of water, caused by the nozzle itself.

BRIEF DESCRIPTION OF THE INVENTION

An aeration system according to this invention includes a cavitating type mixer-injector which receives a stream of water under pressure. It has a flow passage through it which includes a constricting portion, an injection portion, and an expanding portion in that order. An injection port enters the injection portion, through which air is supplied to the stream of water in the flow passage.

According to this invention a group of twisting vanes is provided in the constricting portion, and a group of straightening vanes is provided in the expanding portion, whereby an outer region of the stream is first given a twist relative to its core to provide additional shear and turbulence in the injection portion, and thereafter the straightening vanes straighten the outer region of the stream while providing still more shear in the stream. As a consequence, the air is thoroughly mixed in the stream, and micro bubbles are also produced.

The stream from the mixer-injector to the nozzle flows through a conduit of substantial length in which the dwell time of the water is sufficient to enable substantial transfer of oxygen from the bubbles into the water stream in accordance with Henry's law.

Further according to this invention, the conduit discharges into a nozzle having a constricting portion that includes a group of twisting vanes. These impart a twisting component to the outer region of the stream. As this stream discharges into the body of water, its plume has an outer region that both converges toward the center and twists relative to the core of the stream. As a consequence, considerable turbulence is set up in the stream itself, and the outer region tends to draw surrounding water toward itself and mix into it, thereby enlarging the effluent plume compared to a plume produced by the same nozzle without the twisting vanes. The result is an expanding well-mixed stream of water, dissolved oxygen, and oxygen-containing micro bubbles that extends well into the body of water for most advantageous gas transfer and distribution into it.

The above and other features of this invention will be fully understood from the following detailed description and the accompanying drawings, in which:

DETAILED DESCRIPTION OF THE INVENTION

Figure 1:
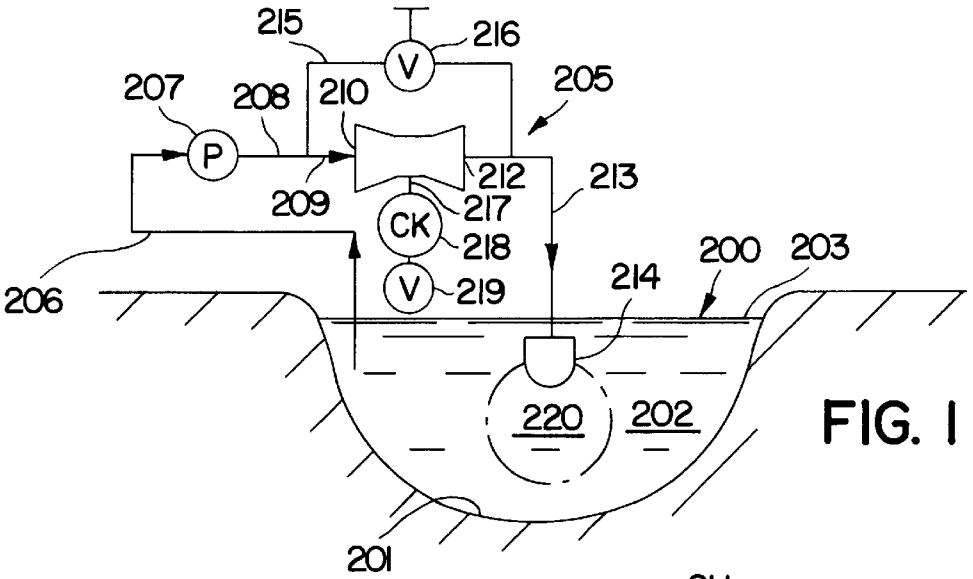
FIG. 1 is a schematic view showing the system of this invention treating a substantial body of water.

This invention is useful for providing oxidizing gas, such as oxygen from the air, into a substantial body of water 200, such as a lake, pool, sump, collection pond or industrial/municipal waste water treatment facilities. The body has a bottom 201 containing water 202 with a surface 203 exposed to the atmosphere.

The system 205 of this invention draws water from the body through an intake conduit 206. Conduit 206 leads to a driven pump 207 that in turn discharges to a conduit 208.

Figure 2:
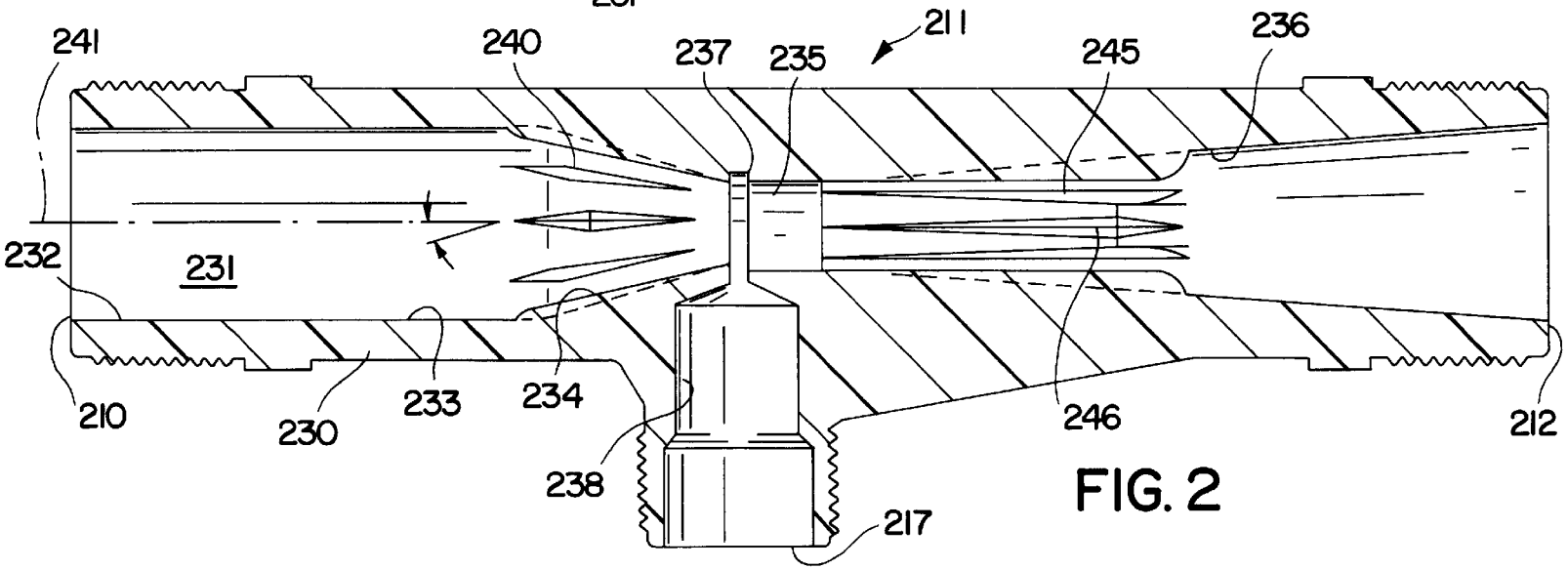
FIG. 2 is an axial cross-section of the presently-preferred mixer-injection used with this invention, taken at line 2—2 in FIG. 3.
Figure 3:
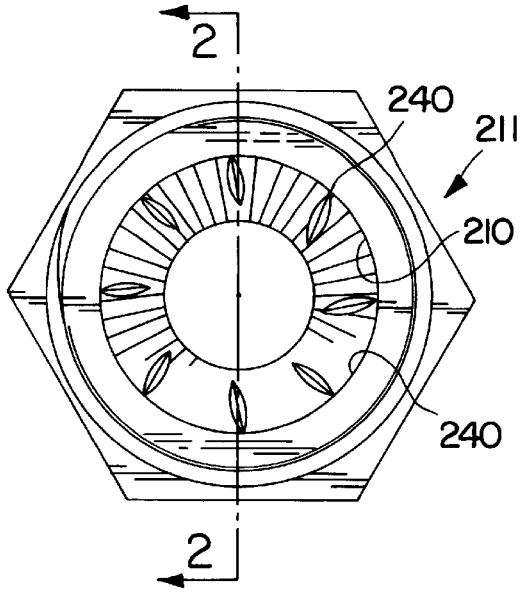
FIG. 3 is a left hand end view of FIG. 2.
Figure 4:
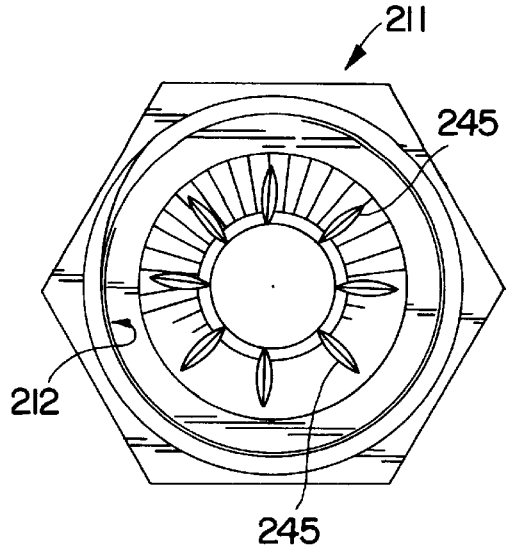
FIG. 4 is a right hand end view of FIG. 2.

Branch 209 of conduit 208 supplies water under pressure to the inlet port 210 of a mixer-injector 211. The mixer-injector is shown schematically in FIG. 1. It is shown in full detail in FIGS. 2–4.

The outlet port 212 of the mixer-injector discharges to return conduit 213. Return conduit 213 has a substantial volume and flow path so as to provide sufficient dwell time of the stream from the mixer-injector for optimum oxygen gas transfer from the bubbles into the water stream. A nozzle 214, shown schematically in FIG. 1, and in detail in FIGS. 5–8 discharges water from return conduit 213 through said nozzle into the body of water, below its surface.

Branch 215 of conduit 208 is a by-pass extending across the mixer-injector. It includes a pressure-regulator or flow control valve 216, adjustable to vary the proportion of flow through the two branches, thereby to regulate or establish the rate of flow through the mixer-injector.

The mixer-injector includes an injection port 217, connected to a unidirectional check valve 218 and a metering valve 219. The metering valve will establish the rate of flow of air or other gas into the mixer-injector for purposes which will later be appreciated.

The water stream from the nozzle enters the body of water with a complex motion yet to be described. It has the effect of creating a region 220, shown schematically in FIG. 1, where water from the nozzle's output mixes with water in the body of water. This invention has as its objective to create an optimally large region of this type, for infusing larger than expected volumes of gas into the body, and for dispersing the nozzle effluent more widely.

Full details of mixer-injector 211 will be found in applicant's presently pending U.S. patent application Ser. No. 08/984,930 filed Dec. 4, 1997, now U.S. Pat. No. 5,863,128, entitled Mixer-Injector which is incorporated herein in its entirety for its detailed showing of the construction and theory of operation of this mixer-injector. For purposes of this invention, it is sufficient to describe its basic elements.

Mixer-injector 211 has a body 230 with a flow passage 231 extending from entry port 210 to exit port 212. An internal wall 232 forming the flow passage includes, from the entry port in this order a cylindrical entry portion 233, a constricting portion 234, an injection portion 235, and an expanding portion 236, which terminates at exit port 212.

Injection port 217 enters the injection portion near to the constricting portion. It preferably exists as a circumferential groove 237 in the internal wall, communicating with a passage 238 that receives treatment gas to be provided to the stream in the flow passage, for example from atmospheric air, oxygen or ozone.

Twisting vanes 240 are provided as a group (eight is a useful number) of individual vanes which as they extend along and around the central axis 241 of the flow passage also extend at an angle to an imaginary plane that passes through them and which includes the central axis. They rise from the entry portion into the constricting portion. They do not cross the central axis. They give a twist to the outer region of the stream, so that when it crosses over the injection port it has an increased turbulence caused by the confluence of the central "core" of the stream (which is not twisted) and the outer portion (which is twisted). This increased turbulence results in a more thorough mixing of the water and the treatment gas, and reduction of size of the micro-bubbles, all to the advantage of this process.

Once this is attained, it is advantageous for the turbulence to be reduced, while still further shearing the micro-bubbles. This is accomplished by the group of straightening vanes 245 which extend along the expanding portion they have crests 246 that are preferably parallel to the central axis, and are spaced apart from it.

The nozzle 214 of this invention is shown in FIGS. 5–8. Full details of this nozzle will be found in applicant's presently pending U.S. patent application Ser. No. 08/889/780, filed Jul. 8, 1997 entitled Infusion Nozzle, now U.S. Pat. No. 5,894,995, which is incorporated herein in its entirety for its detailed showing of the construction and thereby of this nozzle. For purposes of this invention, it is sufficient to describe its basic elements. It includes a body 260 having an outer wall 261 and an inner wall 262. Mounting threads 263 may be provided on the outer wall.

Inner wall 262 forms a flow passage 264 with an inlet port 265 and an exit port 266. The inner wall is circularly sectioned and extends along central axis 267 between the two ports.

Inner wall 262 includes an entry portion 268 that extends from the entry port. It is substantially cylindrical, although it may have a slight narrowing taper if desired. It further includes a constricting portion 269 which is preferably frustoconical. Its diameter lessens as it extends away from the entry portion. The entry portion and constricting portion meet at a junction 272 which is normal to the central axis. Constricting portion 269 extends to exit port 266.

A plurality of twisting vanes 270 are symmetrically placed around the inner wall. In the illustrated example, there are eight of them. More or fewer could be provided, but eight appears to be optimum for the intended results. All are identical, so only one will be described in detail.

The vanes are linear, although they could be slightly curved if desired. However, these nozzles will usually be molded with the use of a mold cavity to form the outside wall, and a plug to form the inside wall, including the vanes. With the disclosed geometry of the inner wall, the plug can be pulled out axially without rotating it.

Vanes 270 are slanted at a small deflection angle 271, between about 3 to 15 degrees, but usually about 4 degrees, relative to an imaginary plane which includes the central axis and also passes through junction 272 where it crosses the vane. While quite small, this angularity gives a sufficient rotational component to an outer portion of the stream for the purposes of this invention.

Figure 8:
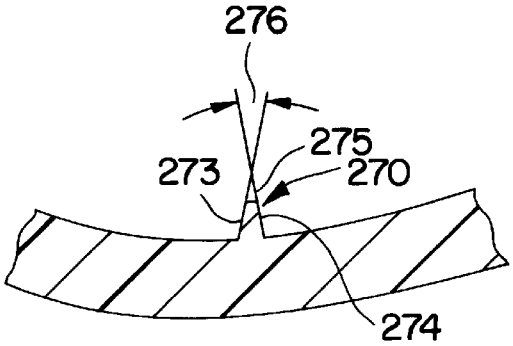
FIG. 8 is a fragmentary cross-section taken at line 8—8 in FIG. 5.

The twisting vanes are preferably formed with a wedge-like shape as shown in FIG. 8. Each has a deflection face 273 facing toward the oncoming stream, and a rear face 274 facing toward the exit port. It is a convenience in molding to provide a flat surface as the crest 275 of the vane. The faces preferably form a dihedral angle 276 preferably about 20 degrees, but which can vary between about 5 degrees to about 40 degrees. This further facilitates the removal of the plug after the device is molded.

The vanes are aligned with one another. Each extends partway into the entry portion, and partway into the constricting portion. Their ends 277 are spaced from the exit port, and their ends 278 are spaced from entry port. They extend across junction 272. Their crests extend at a crest angle 279 (see FIG. 9) relative to the central axis so as to rise from the entry portion, and to fair into the constricting portion. It will be noticed that the vanes do not reach the central axis. It is not intended to rotate the entire stream, but only a limited outer portion of it.

Figure 5:
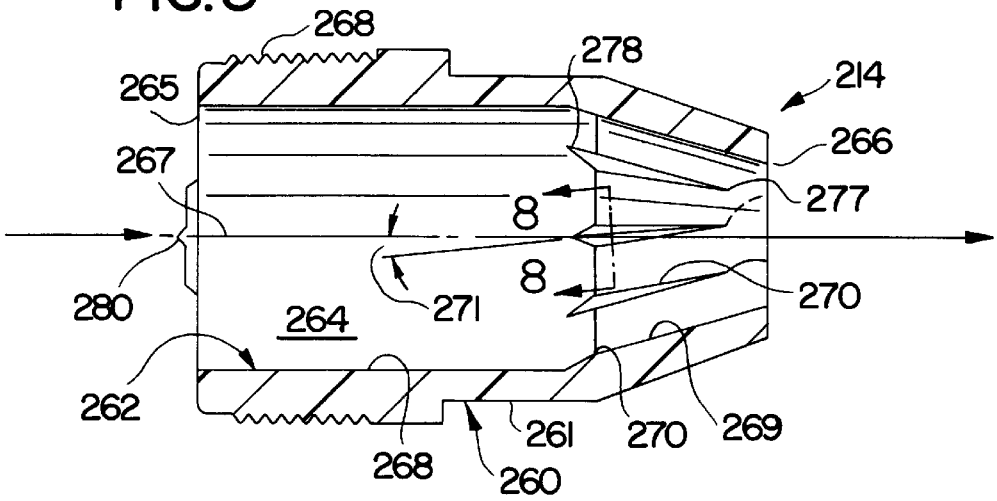
FIG. 5 is an axial cross-section of the presently-preferred nozzle used with this invention, taken at line 5—5 in FIG. 6.
Figure 6:
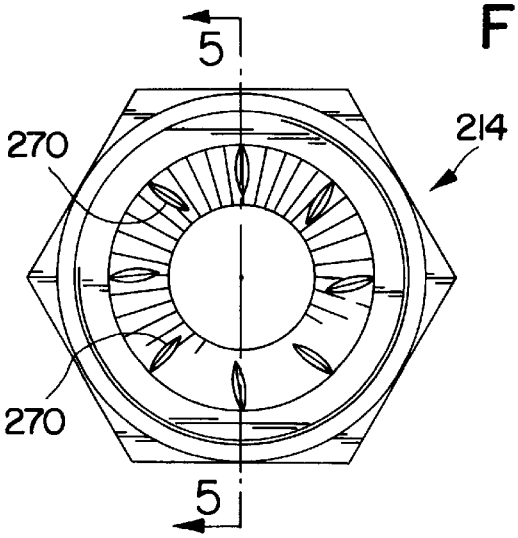
FIG. 6 is a left hand end view of FIG. 5.
Figure 7:
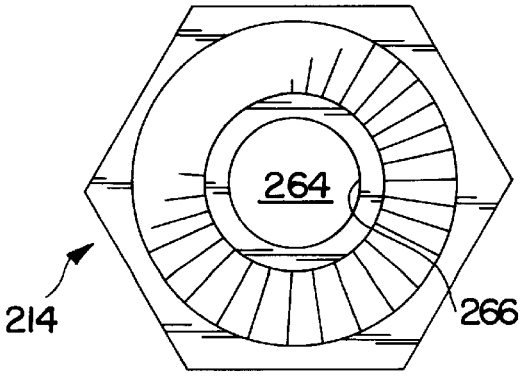
FIG. 7 is a right-hand end view of FIG. 5.
Figure 9:
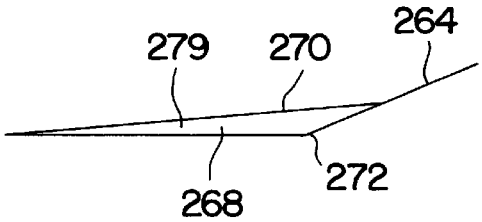
FIG. 9 is a schematic view showing a different twisting vane.
Figure 10:
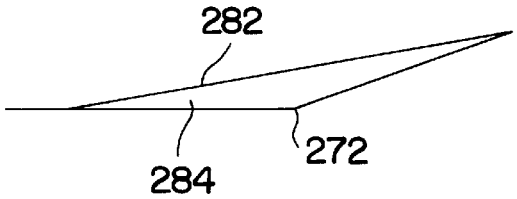
FIG. 10 is a schematic view showing a different twisting vane.
Figure 11:
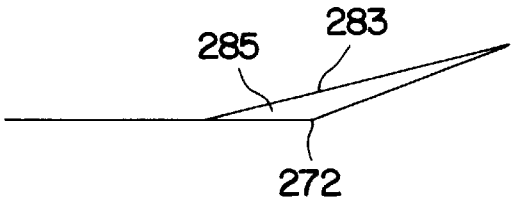
FIG. 11 is a schematic view showing a different twisting vane.

As can best be seen in FIG. 5, the central axial core region 280 of the stream does not encounter a vane. While more occlusion can be provided by using more vanes, or even by using steeper vanes, or vanes which approach the axis more closely, it would be at the cost of an unnecessary increase in energy loss from the stream. The illustrated arrangement, which can be scaled, provides a sufficient rotational effect. FIGS. 9, 10 and 11 schematically show vanes 270, 282, and 283 formed by cutting the slots at different angles 279, 284 and 285. These change the length, height, and excursion into the wall portions as shown. This is a convenient way to provide vanes for different diameters and flow rates. Generally the angle shown in FIGS. 5 and 9 is preferred. Its angle 279 is about 15 degrees, but it can vary between about 5 degrees and 20 degrees.

Figure 12:
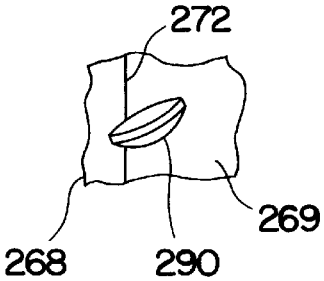
FIG. 12 is a schematic view showing still another different twisting vane.

FIG. 12 shows a vane 290 in all respects like vane 270 in FIG. 5 except that it is slightly curved rather than straight, to provide additional twist to the outer part of the stream, if desired.

While the actual dynamics of this infusion nozzle are not fully understood, the following description of the results it provides will be helpful.

Figure 13:
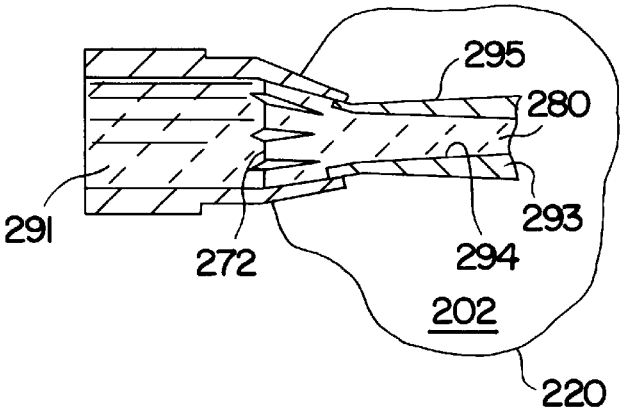
FIG. 13 is a fragmentary schematic cross-section showing the geometry of the effluent stream from the nozzle.

FIG. 13 schematically shows a stream 291 of water, usually containing dissolved and undissolved treatment gas being injected into water 202. While in the nozzle, the vanes have given a rotational component of motion to at least a part of a peripheral zone 293 of water. The central core 280 does not have the twisting component because it does not encounter a vane. Zone 293 is formed around core 280, almost as a cylindrical coaxial shell.

Mixing will immediately begin at the interface 294 between the zones. This rotary and axial mixing motion continues as the stream from the nozzle passes into the body of water. In the body of water this will also occur at the interface 295 between the water in the body and zone 293. As a consequence, an increased amount of mixed waters occurs in a steadily enlarging region 220 (FIGS. 1 and 13), which enlarges both the injected water and into the core.

Comparisons of the outputs of nozzles which are identical except that one has vanes and the other does not, are instructive. Without vanes, there is no peripheral zone 293. There is some mixing around the axial stream, but it is small, and mixing does not start until the stream is well into the tank. If one places his hand underwater around the stream next to the nozzle and moves it along the stream, he will notice that the mixing region around the stream, which he can actually feel, starts rather far into the tank, and is not particularly vigorous. Bubbles of gas will often be seen rising to the surface.

If one replaces that nozzle with a nozzle according to the invention and repeats this exercise, he finds very close to the exit port the start of a region 293 of vigorous mixing. Peripheral zone 293 has an interface 295 with the surrounding water in the body of water as well as with interface 294 with the axially-moving core. Region 293 can be felt blooming to an increasing and substantial diameter, within which shear forces on the bubbles at both interfaces lead to their rapid disappearance as their gas is dissolved. There is a substantial absence of bubbles at the surface.

A set of dimensions suitable for a nozzle according to this invention is as follows:

Included conical angle of the constricting portion: 40 degrees

Diameter of the entry portion: 1.60 inches

Exit port diameter: 0.75 inches

Angle of the vanes relative to the plane through the central axis: 4 degrees

Distance from the exit port to the nearest end of the vanes: 0.25 inches.

These dimensions are useful and pertinent for the entry portion of the mixer-injector and its vanes, which are identical, and the details, dimensions and functions of both are identical.

Useful dimensions for the injection portion and expanding portions of the mixer-injector are as follows, in inches:

Diameter of injection portion: 0.79

Largest diameter of expansion portion: 1.55

Axial length of injection portion: 0.655

Axial length of expanding portion: 5.660

Axial length of straighten vanes: 3.05

This invention is not to be limited by the embodiments shown in the drawings and described in the description, which are given by way of example and not of limitation, but only in accordance with the scope of the appended claims.

I claim:

1. A system for aerating substantial bodies of water, comprising:

a cavitating mixer-injector having a body with an internal wall forming a flow passage having a central axis and extending from an entry port to an exit port, and having a constricting portion, an injection portion, and an expanding portion in that order from said entry port to said exit port, a group of twisting vanes in said constricting portion, and a group of straightening vanes in said expanding portion, said vanes having a crest spaced from said central axis, and an injection port opening into said injection portion for admitting gas into said injection portion;

a conduit connected to said exit port, said conduit having a volume and a dimension of length; and a nozzle connected to said conduit, said nozzle having an internal wall forming a flow passage with a central axis therethrough extending from an inlet port to an exit orifice, said wall of said nozzle having a constricting portion narrowing toward said exit orifice, a group of twisting vanes formed on the wall of said nozzle constricting portion, spaced from said central axis, extending axially and forming an acute angle with an imaginary plane which passes through them and includes the central axis of the nozzle, whereby water forced into said mixer-injector flows through it, then through the conduit and then through the nozzle, whereby, when submerged in a body of water, the effluent from said nozzle enters the body of water with a burden of gas injected into the injection portion to form a plume of combined effluent and water in said body of water.

2. A system according to claim 1 in which the volume and length of said conduit is sufficient to provide for dwell time for a suitable amount of gas injected into said injection portion to dissolve in the water.

* * * * *